United States Patent [19]

Witschi

[11] Patent Number: 4,959,940

[45] Date of Patent: Oct. 2, 1990

[54] CANTILEVER PLATE CONNECTING ASSEMBLY

[75] Inventor: Heinz Witschi, Ortschwaben, Switzerland

[73] Assignee: Bau-Box Ewiag, Oberdiessbach, Switzerland

[21] Appl. No.: 339,678

[22] Filed: Apr. 18, 1989

[30] Foreign Application Priority Data

Apr. 22, 1988 [CH] Switzerland ..... 1505/88

[51] Int. Cl.[5] ..... E04C 2/06

[52] U.S. Cl. ..... 52/583; 52/230; 52/251; 52/227

[58] Field of Search ..... 52/227, 230, 583, 250, 52/251, 252, 259, 260, 262, 73, 601, 587, 223 R

[56] References Cited

U.S. PATENT DOCUMENTS 3,283,458 11/1966 Gersouttz ..... 52/251 X
3,782,057 1/1974 Gross ..... 52/73 X
4,070,848 1/1978 Lingle ..... 52/583 X
4,781,006 11/1988 Haynes ..... 52/583

FOREIGN PATENT DOCUMENTS 0119165 9/1986 European Pat. Off. .
2400928 7/1975 Fed. Rep. of Germany ..... 52/601
3116381 11/1982 Fed. Rep. of Germany .

*Primary Examiner*—Richard E. Chilcot, Jr.
*Attorney, Agent, or Firm*—Lee, Mann, Smith, McWilliams & Sweeney

[57] ABSTRACT

A cantilever plate connecting assembly consists of an insulation body (3) with reinforcement bars (5) extending therethrough. The reinforcement bars (5) are embedded, on one side of the insulation body (3) in a cantilever plate (1) and, on the other side, in a floor-ceiling plate (2). On both sides of the insulation body (3) there are provided face plates (6) made of stainless steel, which have a tensile bar (5) and a pressure reinforcement bar (5) extending therethrough. The advantage of the construction lies in the optimization of statics, service life and safety.

5 Claims, 2 Drawing Sheets

CANTILEVER PLATE CONNECTING ASSEMBLY

BACKGROUND AND SUMMARY OF THE INVENTION

The present invention relates to a cantilever plate connecting assembly for the insulated, close-linkage joining of a floor-ceiling plate to a cantilever plate, with a slab-form insulation body, and reinforcing bars extending therethrough.

Cantilever plate connecting elements and assemblies of the above mentioned construction type have been known for a few years in various configurations. In DE-A No. 3116 381 (Schock) there was described for the first time a cantilever plate connecting assembly of the above-mentioned type, in which, in addition to the tensile bars crossing the joint, pressure elements are further installed in the insulation body which take over the transfer of the pressure forces. A second form of a connecting structure is shown in EP-A No. 0119165 (W. Egger) which uses bars shaped in loops but without any additional transverse-force bars. A tensile bar and a pressure bar together form a loop. Acting against the spreading effect of the two bars, there are brackets located on both sides, which in the installed position are set in concrete in the corresponding plates.

Recently there have been cantilever plate connecting assemblies on the market which likewise present no pressure elements, but have, in addition to the tension bars and pressure bars, transverse-force bars. DE-A No. 34 46006 suggests further, that the bars be provided with corrosion-resistant sleeves in the zone of the joint.

In the appraisal of cantilever plate connecting assemblies three pointws are of special importance:

(a) The statics that are influenced by the choice of material and the dimensioning;

(b) The service life and therewith the safety, which is influenced by the choice of material and the protection against corrosion; and (c) Finally, the cost, which stands diametrically opposed to the preceding criteria.

The present invention is directed to the problem of creating an optimal solution with respect to the three criteria. This problem is solved by a cantilever plate connecting assembly that is distinguished in that at least two reinforcing bars, in vertical arrangement one over the other, are held on both sides of the insulation body in face plates of corrosion-resistant material.

BRIEF DESCRIPTION OF THE DRAWINGS

In the drawings, two embodiments of the invention are represented and described with the aid of the following specification.

DETAILED DESCRIPTION OF THE INVENTION

Figure 1:
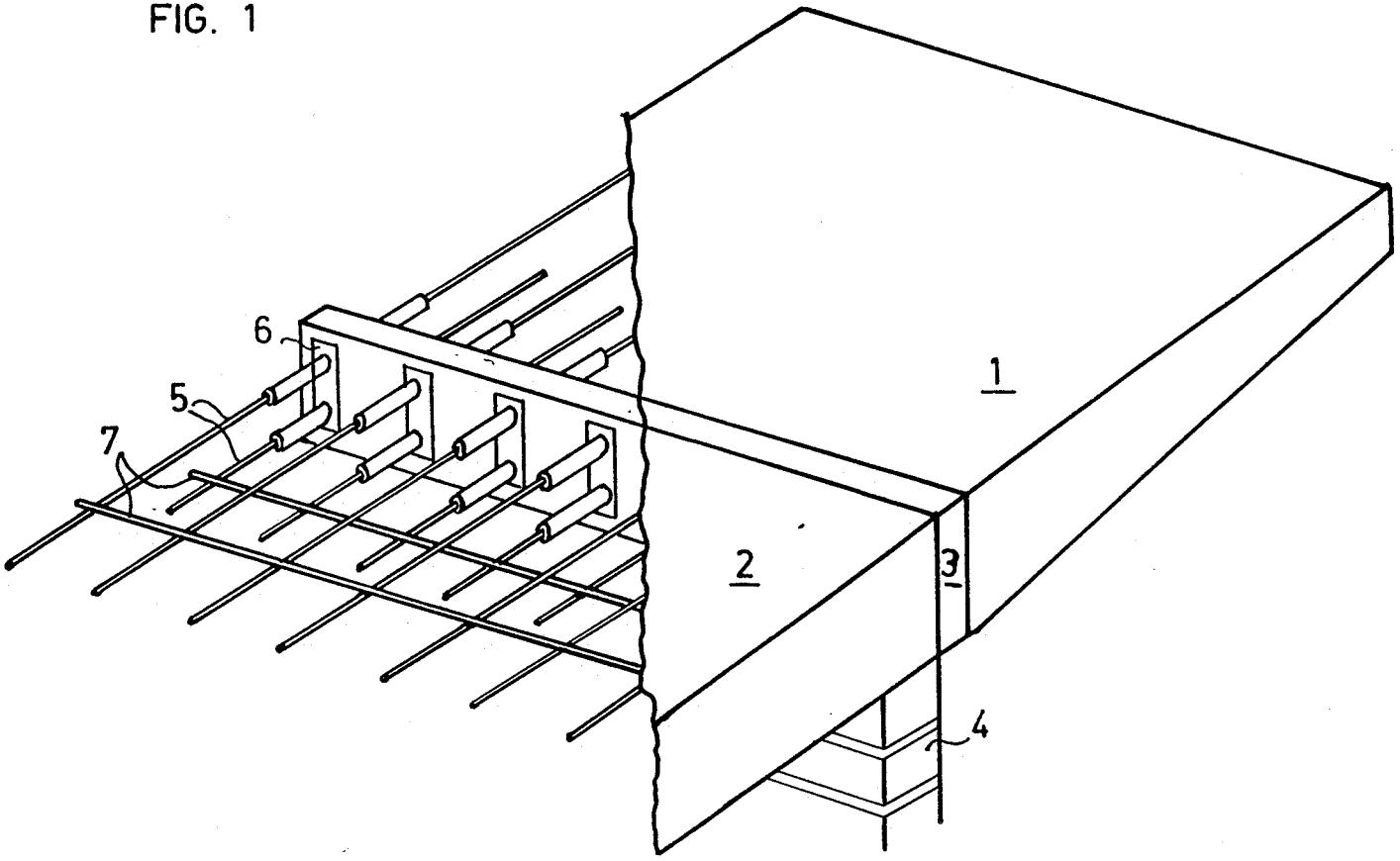
FIG. 1 is a perspective view of an embodiment of the inventive connecting assembly with tension bars and pressure bars, shown partially in the installed position.

An especially important area of use for cantilever plate connecting assemblies is for balconies. The balcony accordingly is the overhanging, or cantilever, plate 1, which must be joined with the building, in particular with the floor-ceiling plate 2 lying in the same plane. This joint is connected by the cantilever plate connecting assembly. The required heat- and noise-insulation between the two concreted plates 1 and 2 is accomplished by means of an insulation body 3.

The floor-ceiling plate 2 rests on masonry 4, while the cantilever plate 1 is suspended on the reinforcing bars 5. According to their load the reinforcing bars 5 are called tension bars or pressure bars. In the installed position the upper bars are predominantly subjected to tension (pull) forces and the lower bars predominantly to pressure forces, which are brought about by the torque of the weight and the load of the cantilever plate 1. In each case one tension bar and one pressure bar 5, which in the installed position are arranged at least approximately vertically one over the other, are grouped together in pairs by means of corrosion-resistant face plates 6 on either side of the insulation body 3. The face plates 6 in the installed state for the assembly are arranged with one side thereof at the face surface of the respective concrete plate 1 or 2, and with the other side directly on the insulation body 3, and together form the cantilever plate connecting assembly. For the stiffening of the assembly and for the joining of the same with reinforcing bar networks in the floor-ceiling plate 2 and the cantilever plate 1, respectively, it is possible for all the tensile bars as well as all the pressure bars of an element to be joined with at least one transverse bar 7 running parallel to the longitudinal direction of the insulating body 3.

In the simplest embodiment, all the tensile bars and pressure bars can be of inexpensive structural steel, and can be protected only by a coating against corrosion. The face plates 6, however, must be made of corrosion-resistant material, such as, for example, stainless steel. The face plates 6 have a multiple function. In the first place they serve, as already described, to hold a tensile bar and a pressure bar each. Further, like the brakets in the EU-A No. 0119165 cited at the outset, they also serve to counteract the spreading effect of the pressure and tensile bars 5 in the joint region. However, they are more effectively arranged than the brackets mentioned, since they lie directly at the joint, and, therefore, are effective earlier.

A further function has proved to be especially effective. Through changing load on the cantilever plate 1, the reinforcing bars 5 are elastically deformed, even if only in a limited scope. As a result, in the zone of the entrance of the reinforcing bars into the concrete plates, concrete particles are again and again dislodged. This creates two serious problems: in the first place there arises more and more corrosion of the bars and, in the second place, there is an erosion of concrete, which results in a further dislodging of concrete. On the other hand, the static forces change the longer the period of time that is part of the reinforcing bars is no longer held in the concrete. Through the use of the face plates, according to the invention, these problems can be avoided without it being necessary to resort to oversized and stainless reinforcing bars. Accordingly, the safety and the service life can be increased without appreciably effecting the cost of the cantilever plate connecting assembly.

Figure 2:
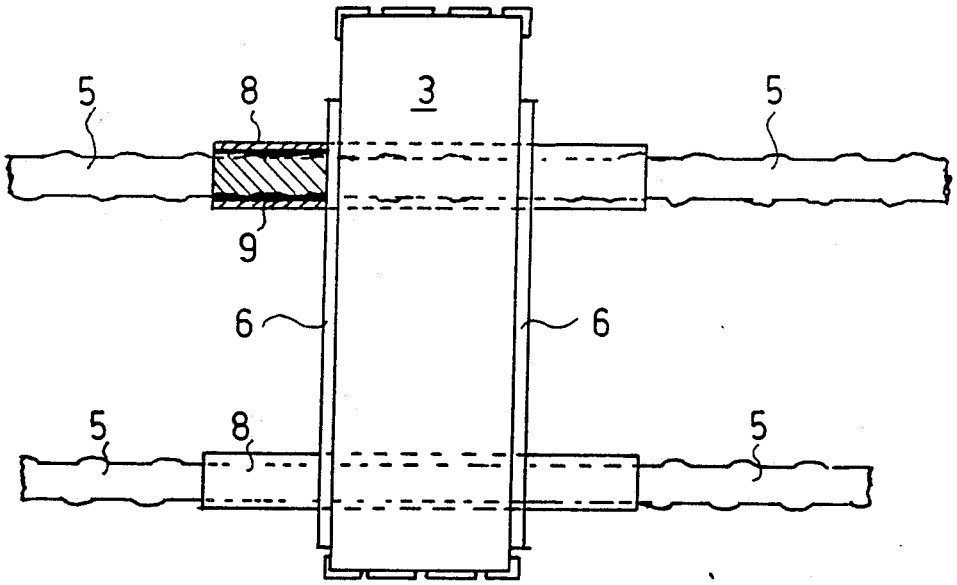
FIG. 2 is a side view of the connecting assembly on a larger scale.

On the basis of these considerations, a further step may be provided. In FIG. 2, in which a side view is presented, it is clearly seen that the reinforcing bars 5 are enveloped in each case with a sheath 8. These sheaths 8, are also of noncorroding material, for example stainless steel. The sheaths 8 do not touch the reinforcing bars 5. Therefore, there is created a hollow space, which is filled with a hardening material 9. Good results have been achieved with synthetic material-improved mortar, which presents a very high pressure strength. The pressure strength of the material must in any case be equal to or greater than that of the concrete. Preferably the hardness should amount to more than 500 kg/cm$^2$. The sheaths 8 are dimensioned in such a way that in the installed state they extend into the concrete plates 1 and 2 on both sides. With this formation the danger of corrosion of the bars 5 is completely avoided without it being necessary to resort to the expensive, stainless steel for the entire bars.

The "sandwich construction" of the bars in the joint region, however, improves quite especially the strength of the reinforcing bars to be subjected to pressure. Of course, the sheaths 8 extend through the face plates 6.

Figure 3:
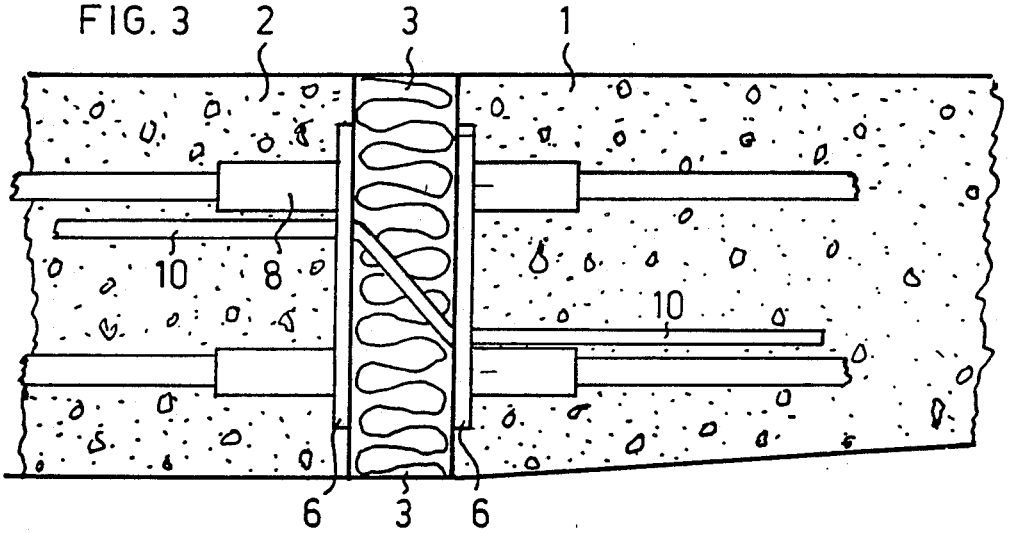
FIG. 3 is a vertical section through a connecting assembly with a reinforcing bar for the transverse forces, in the installed state.

A variation of the invention is represented in FIG. 3 and differs from the embodiment of FIGS. 1 and 2 only by the provision of a transverse force bar 10. The transverse force bar 10 must, however, in contrast to the other reinforcing bars 5, be made completely of stainless steel. The transverse force bar 10 penetrates the face plate 6 on the floor-ceiling plate side barely below the upper tensile bar and, on the cantilever plate side, barely above the lower pressure bar, which construction permits a slight reduction of the diameter of the other reinforcing bars. In many cases this solution may be preferred.

The insulation body 3 can, as is well known, be of rock wool or foamed synthetic material. With use of synthetic material, the insulation body 3 can be foamed directly onto the cantilever plate connecting assembly.

What is claimed is:

1. A cantilever plate connecting assembly for the insulated, closed-linkage joining of a floor-ceiling plate (2) to a cantilever plate (1), having a slab-form insulation body (3) therebetween and reinforcing bars (5) extending through the insulation body (3) comprising at least two in vertical arrangement one over another and being held by face plates on both sides of the insulation body (3), said face plates (6) being made of corrosion-resistant material, and wherein the reinforcing bars (5), at least in the portion thereof extending through the insulation body (3), are surrounded with corrosion-resistant sheaths (8), wherein a space is formed between each sheath (8) and reinforcing bar (5), said space being filled with a hardening composition (9) which has a greater hardness than concrete, and the sheaths (8) extend through the face plates (6).

2. A cantilever plate connecting assembly according to claim 1, further including at least one transverse force bar (10) of corrison-resistant material that provides for the absorption of transverse forces and the transverse force bar being held by the face plates (6).

3. A cantilever plate connecting assembly according to claim 1, wherein the space is filled with a mortar improved by synthetic material.

4. A cantilever plate connecting assembly according to claim 1, wherein the insulation body (3) consists of a directly foamed material.

5. A cantilever plate connecting assembly according to claim 1, wherein the space is filled with a material that has a hardness of more than 500 kg/cm$^2$.

* * * * *